US008375590B2

(12) United States Patent
Duey

(10) Patent No.: US 8,375,590 B2
(45) Date of Patent: Feb. 19, 2013

(54) KNIFE BLADE OPENING MECHANISM

(75) Inventor: Wes Duey, Oregon City, OR (US)

(73) Assignee: Mentor Group, L.L.C., Oregon City, OR (US)

( * ) Notice: Subject to any disclaimer, the term of this patent is extended or adjusted under 35 U.S.C. 154(b) by 213 days.

(21) Appl. No.: 13/004,178

(22) Filed: Jan. 11, 2011

(65) Prior Publication Data

US 2011/0099817 A1 May 5, 2011

Related U.S. Application Data

(63) Continuation-in-part of application No. 12/792,920, filed on Jun. 3, 2010, now Pat. No. 8,171,645, which is a continuation of application No. 11/899,206, filed on Sep. 5, 2007, now Pat. No. 7,748,122.

(51) Int. Cl.
*B26B 3/06* (2006.01)

(52) U.S. Cl. ..... 30/159; 30/160

(58) Field of Classification Search ..... 30/153, 30/155, 158–161

See application file for complete search history.

(56) References Cited

U.S. PATENT DOCUMENTS

| | | | | |
|---|---|---|---|---|
| 2,741,841 | A * | 4/1956 | Egeth | 30/135 |
| 3,834,022 | A * | 9/1974 | Students | 30/261 |
| 5,029,354 | A | 7/1991 | Boyd, Jr. et al. | |
| 5,044,079 | A * | 9/1991 | Gibbs | 30/160 |
| 5,819,414 | A | 10/1998 | Marifone | |
| 6,308,420 | B1 * | 10/2001 | Moser | 30/161 |
| 6,363,615 | B1 * | 4/2002 | Moser | 30/161 |
| 6,574,869 | B1 * | 6/2003 | McHenry et al. | 30/161 |
| 6,651,344 | B2 * | 11/2003 | Cheng | 30/159 |
| 6,675,484 | B2 * | 1/2004 | McHenry et al. | 30/161 |
| 6,732,436 | B2 * | 5/2004 | Moizis | 30/155 |
| 7,086,157 | B2 * | 8/2006 | Vallotton | 30/159 |
| 7,107,686 | B2 * | 9/2006 | Linn et al. | 30/159 |
| 7,243,430 | B1 * | 7/2007 | Lerch | 30/160 |
| 7,278,213 | B2 * | 10/2007 | Pardue et al. | 30/160 |
| 7,293,360 | B2 * | 11/2007 | Steigerwalt et al. | 30/160 |
| 7,313,866 | B2 * | 1/2008 | Linn et al. | 30/159 |
| 7,325,312 | B1 * | 2/2008 | Janich | 30/161 |
| 7,380,340 | B1 * | 6/2008 | Lerch | 30/159 |
| 7,437,822 | B2 * | 10/2008 | Flagg et al. | 30/161 |
| 7,627,951 | B2 * | 12/2009 | Glesser | 30/161 |
| 7,676,931 | B2 * | 3/2010 | Knight et al. | 30/158 |
| RE41,259 | E * | 4/2010 | McHenry et al. | 30/161 |

(Continued)

FOREIGN PATENT DOCUMENTS

| | | |
|---|---|---|
| FR | 2793182 A3 | 11/2000 |
| FR | 2836854 A1 | 1/2003 |

(Continued)

OTHER PUBLICATIONS

International Search Report and Written Opinion of the International Searching Authority for PCT/US2011/64793, which is a PCT of the present application; mailed Apr. 20, 2012.

(Continued)

*Primary Examiner* — Jason Daniel Prone
(74) *Attorney, Agent, or Firm* — Hancock Hughey LLP

(57) ABSTRACT

A folding knife incorporates an opening assist mechanism that functions to drive the blade from the closed to the open position. A torsion spring is retained axially on the blade axis pin and within a bushing that is stationary relative to the knife handle. One leg of the spring is fixed relative to the handle. The opposite leg of the spring extends through and rides in a partial annular groove in the bushing and acts on the blade as it is moved between the open and closed positions.

19 Claims, 10 Drawing Sheets

U.S. PATENT DOCUMENTS

| | | | | |
|---|---|---|---|---|
| 7,698,821 | B2 * | 4/2010 | Ralph | 30/160 |
| 7,748,122 | B2 * | 7/2010 | Duey | 30/159 |
| 7,918,028 | B2 * | 4/2011 | Steigerwalt et al. | 30/155 |
| D639,632 | S * | 6/2011 | Freeman et al. | D8/99 |
| 8,171,645 | B2 * | 5/2012 | Duey | 30/159 |
| 2002/0124415 | A1 * | 9/2002 | Mizutani et al. | 30/261 |
| 2003/0140500 | A1 * | 7/2003 | Cheng | 30/159 |
| 2004/0154170 | A1 * | 8/2004 | Kain et al. | 30/161 |
| 2004/0158991 | A1 | 8/2004 | Freeman | |
| 2004/0261272 | A1 * | 12/2004 | Moser | 30/160 |
| 2005/0223562 | A1 | 10/2005 | Pardue et al. | |
| 2006/0059694 | A1 * | 3/2006 | Carter, III | 30/159 |
| 2006/0064877 | A1 * | 3/2006 | Vallotton et al. | 30/155 |
| 2007/0137047 | A1 * | 6/2007 | Kim | 30/161 |
| 2007/0169354 | A1 * | 7/2007 | Ralph | 30/160 |
| 2007/0180702 | A1 * | 8/2007 | Hawk et al. | 30/161 |
| 2008/0201953 | A1 | 8/2008 | Bremer et al. | |
| 2009/0056146 | A1 | 3/2009 | Duey | |
| 2009/0119926 | A1 * | 5/2009 | Nenadic | 30/161 |
| 2009/0265939 | A1 * | 10/2009 | Chu | 30/159 |
| 2009/0277015 | A1 * | 11/2009 | Duey | 30/160 |
| 2009/0288301 | A1 * | 11/2009 | Hawk et al. | 30/161 |
| 2010/0140059 | A1 | 6/2010 | Kagami et al. | |
| 2011/0162211 | A1 * | 7/2011 | Maxey | 30/155 |
| 2012/0047746 | A1 * | 3/2012 | Caswell | 30/161 |
| 2012/0234142 | A1 * | 9/2012 | Onion | 30/155 |

FOREIGN PATENT DOCUMENTS

WO WO 2009136987 A1 * 11/2009

OTHER PUBLICATIONS

Extended European Search Report from related European Application No. 08795104.2-2313 / 2183080 (PCT/US2008/009480), Apr. 26, 2011.

* cited by examiner

KNIFE BLADE OPENING MECHANISM

RELATED APPLICATIONS

This application is a continuation in part of U.S. patent application Ser. No. 12/792,920, filed 3 Jun. 2010, now U.S. Pat. No. 8,171,645 B2, which is a continuation of U.S. patent application Ser. No. 11/899,206, filed 5 Sep. 2007, now U.S. Pat. No. 7,748,122 B2.

FIELD OF THE INVENTION

This invention relates to folding knives equipped with mechanisms that provide an opening assist for the blade, and more particularly to a knife in which springs act on the blade to drive the blade from the closed position to the open position.

BACKGROUND

Most folding knives incorporate some kind of a mechanism that holds the blade or working implement in the closed position in which the sharp edge of the blade is held safely within the handle. There are many known mechanisms for retaining blades in the closed position, and there are obvious reasons why such mechanisms are used. Among other reasons, blade-retaining mechanisms prevent unintended opening of the knife and thus promote safety.

Automatic opening mechanisms and so-called "opening assist" mechanisms may be incorporated into folding knives. Generally speaking, in a knife that has an automatic opening mechanism the blade is held in the closed position by a latched trigger mechanism. When closed, the blade is under a constant "pre-load" pressure from a spring mechanism. When the trigger is released, the blade is automatically driven by the spring mechanism into the open position. On the other hand, with knives that incorporate opening assist mechanisms the blade is retained in the closed position without the need for a latch or trigger. The opening assist function is provided by a spring mechanism that operates on the blade. As the user manually rotates the blade from closed toward the open position, the spring mechanism that acts on the blade reaches a threshold point. After the blade rotates beyond the threshold point the spring drives the blade to the open position.

Both knives equipped with automatic and opening assist mechanisms typically include some kind of locking mechanism to lock the blade open, and with many opening assist knives the same spring mechanism that drives the blade open also retains the blade closed.

For a variety of reasons, opening assist mechanisms are becoming very popular. For example, in appropriate circumstances and for appropriate users, there are many advantages to be derived from assisted opening knives and many situations where automatic knives can be useful. These often include situations where the user has only one hand free. However, even in a knife that includes an automated opening or opening assist mechanism, safety considerations always mandate that the blade stays in the closed position until the user volitionally and intentionally moves the blade into the open position. For example, a mechanism that holds a knife blade closed should never release when the knife is dropped. With the recent increases in popularity of opening assist knives there are many new types of mechanisms being developed.

There is always a need however for mechanisms that provide an opening assist feature for knives.

The present invention comprises folding knife having an opening assist mechanism. In a first illustrated embodiment, the mechanism of the present invention relies upon a pair of torsion springs held axially on the blade axis pin and within a pair of bushings that are stationary relative to the knife handle. There is one spring and one bushing on each lateral side of the blade. One leg of each spring is fixed to the bushing. The opposite leg of the spring rides in a pocket formed in the surface of the blade axially around the opening through which the blade axis pin is inserted. When the blade is in the closed position the torsion springs are "loaded" but do not apply their spring force to the blade, instead applying their force against the stationary bushing. As the blade rotates from the closed position toward the open position, the legs of the springs rotate through and cooperate with structures formed on the bushings to transfer the spring pressure instantly from the bushing to the blade to drive the blade open. As the blade is thus rotated from the closed position toward the open position, once a predetermined rotational point, or "threshold" point in the rotational movement of the blade is passed, the mechanism of the present invention rotationally drives the blade into the fully open position. This is accomplished with the paired springs, which act on the blade and thereby impart sufficient rotational kinetic energy to the blade that the inertia drives the blade into the fully open position. A locking mechanism locks the blade in the open position. As the blade is rotated from the open position to the closed position the torsion springs are once again loaded, and once a desired rotational point is passed one leg of each of the spring moves into a pocket in the bushing and the spring's rotational force is transferred from the blade to the stationary bushing, allowing the blade to remain in the closed position.

The mechanism of the present invention may also be built to rely upon only one torsion spring, which is structurally and functionally identical to the paired springs described above.

BRIEF DESCRIPTION OF THE DRAWINGS

The invention will be better understood and its numerous objects and advantages will be apparent by reference to the following detailed description of the invention when taken in conjunction with the following drawings.

The series of FIGS. 10 through 13 illustrate semi-schematically a sequence of structural steps that occur as the blade rotates from the open to the closed positions.

Figure 10:
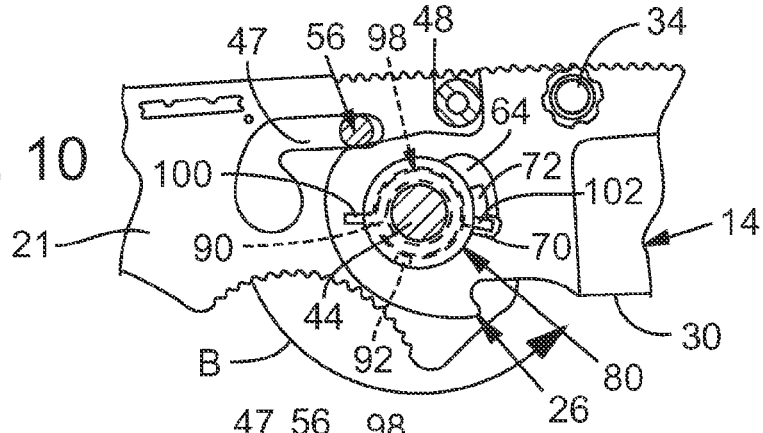

FIG. 10 is a side elevational, semi-schematic and cross sectional view illustrating the structures of the auto assist mechanism when the blade is in the fully open and locked position.

Figure 11:
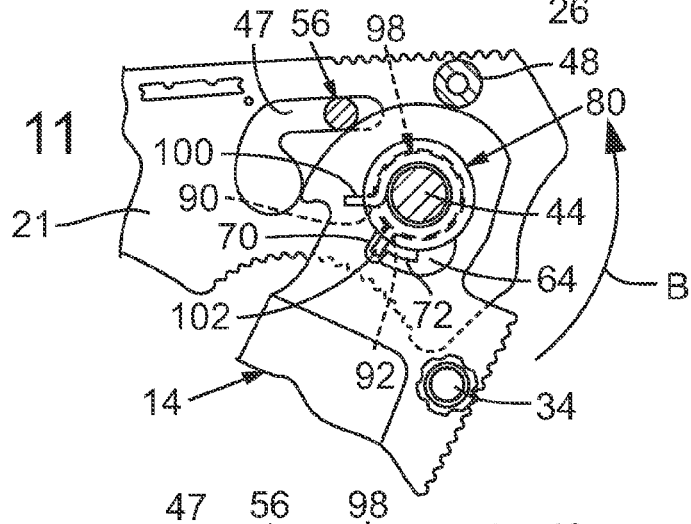

FIG. 11 is a side elevational, semi-schematic and cross sectional view illustrating the structures of the auto assist mechanism when the blade has rotated about 60° from the fully closed position toward the open position.

Figure 12:
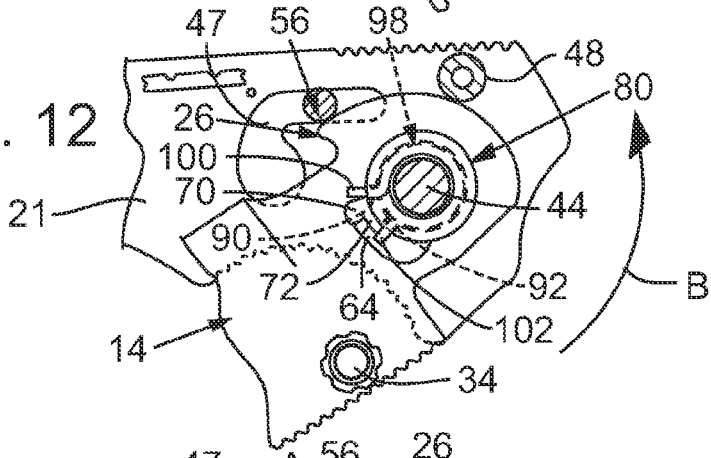

FIG. 12 is a side elevational, semi-schematic and cross sectional view illustrating the structures of the auto assist mechanism when the blade has rotated about 40° from the fully closed position toward the open position.

Figure 13:
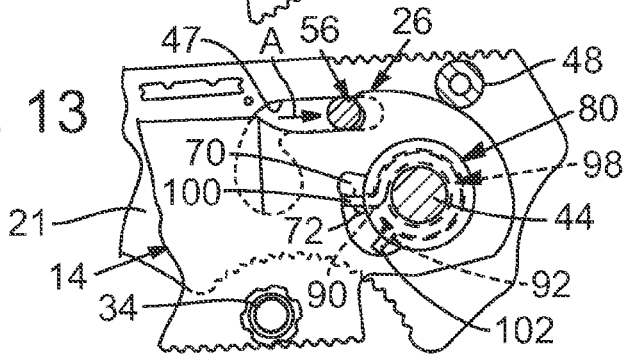

FIG. 13 is a side elevational, semi-schematic and cross sectional view illustrating the structures of the auto assist mechanism when the blade is in the closed position.

Figure 1:
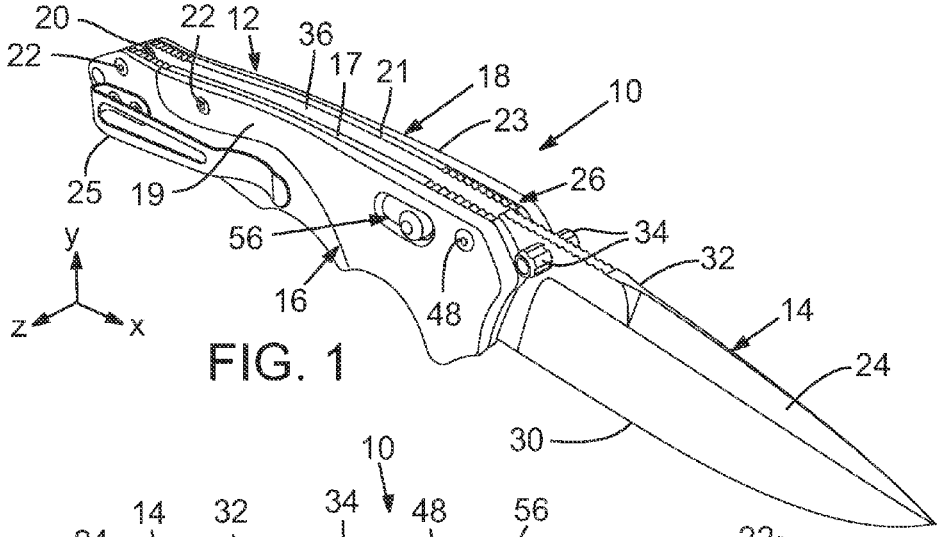
FIG. 1 is perspective view of a first illustrated embodiment of a knife incorporating an opening assist mechanism according to the present invention. The blade of the knife shown in FIG. 1 is in the locked open position.
Figure 14:
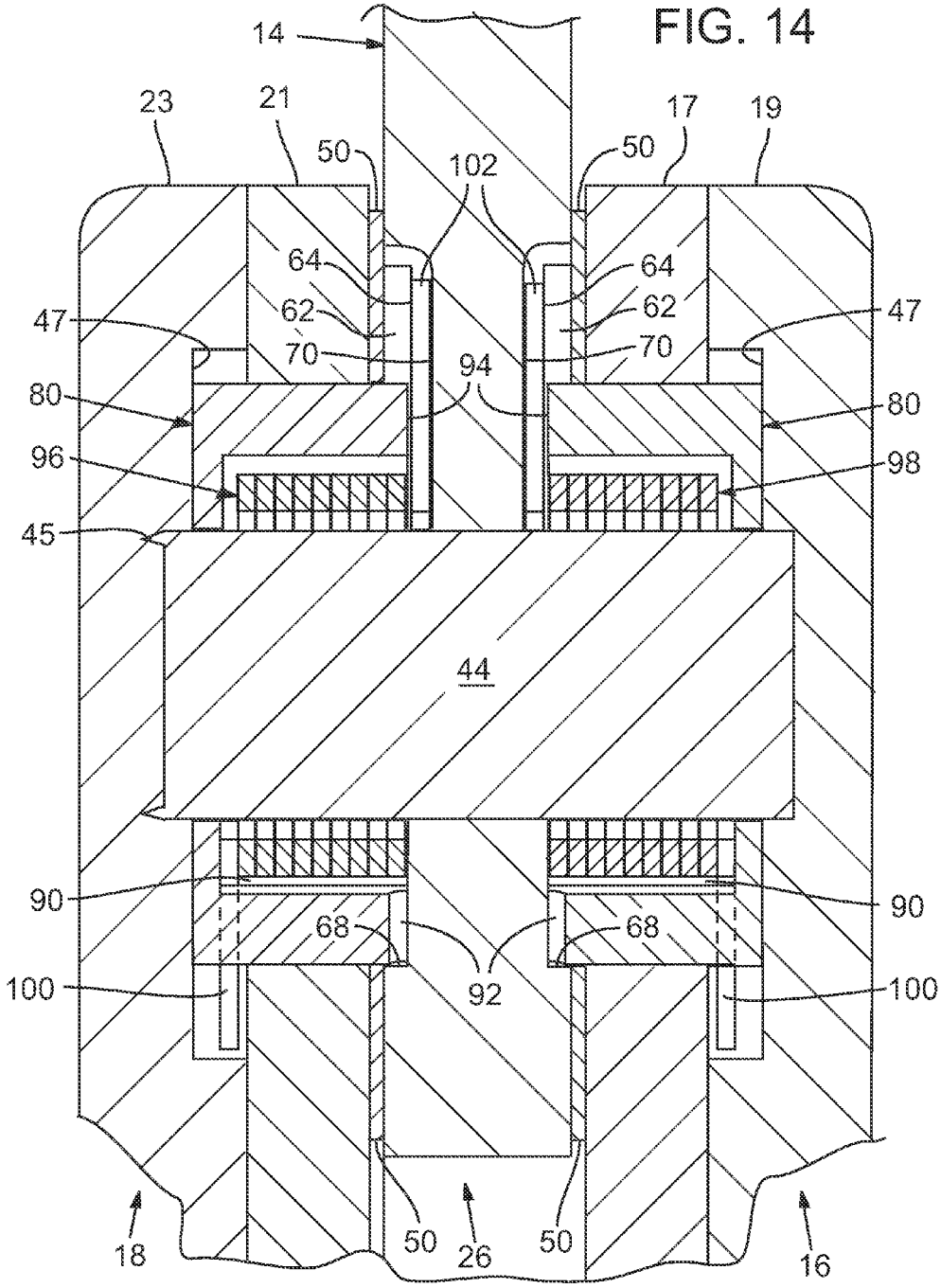

FIG. 14 is a stylized top cross sectional view of the knife of FIG. 1, taken through the forward portion of the handle and through the blade axis, illustrating the blade in the open position.

Figure 15:
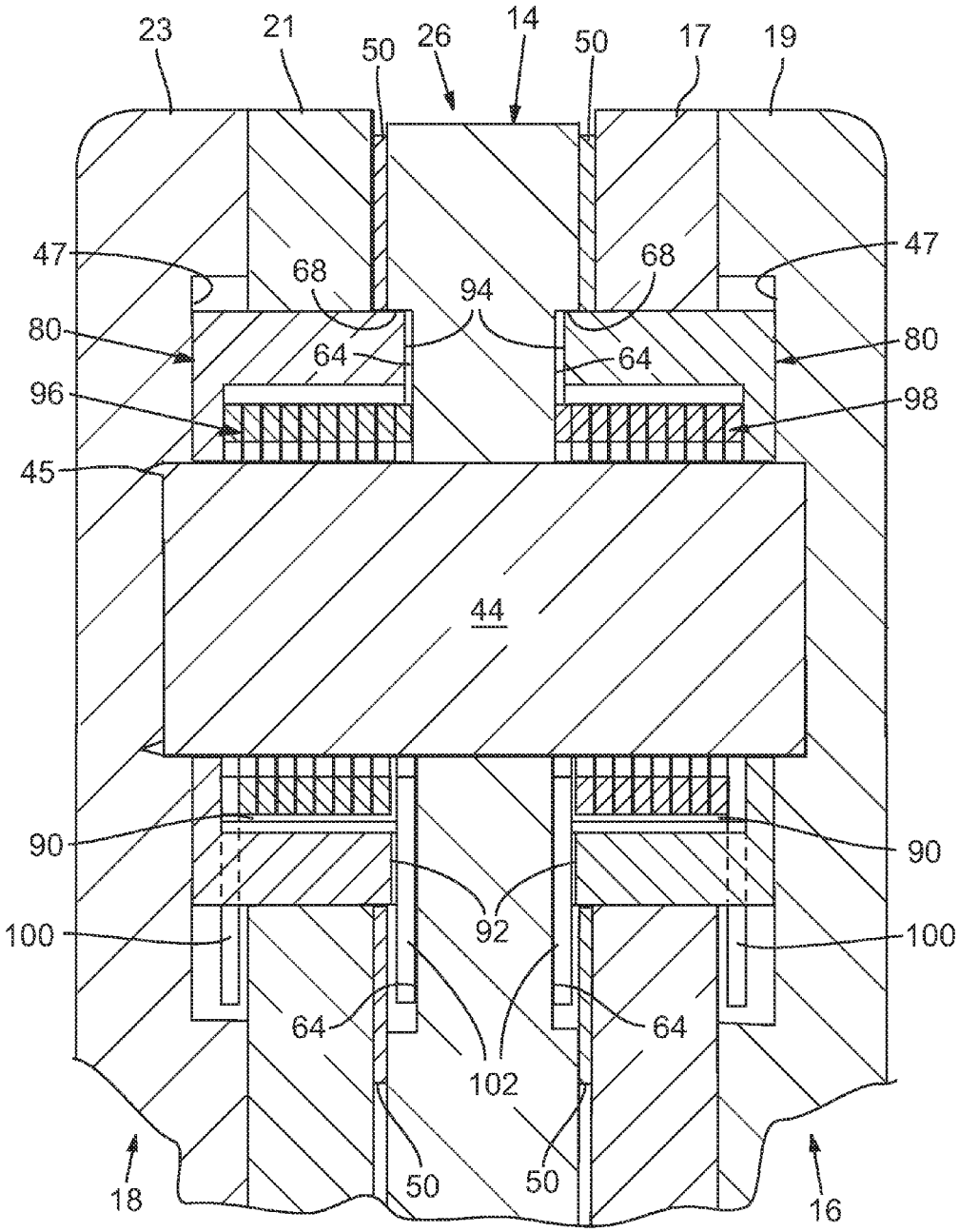

FIG. 15 is a stylized top cross sectional view taken through the same position as FIG. 14, but illustrating the blade in the closed position.

FIGS. 16 through 19 are a series of semi-schematic and semi-cross sectional views illustrating the blade, torsion springs and bushings during a sequence events that occur as the blade is rotated from open to closed.

Figure 16:
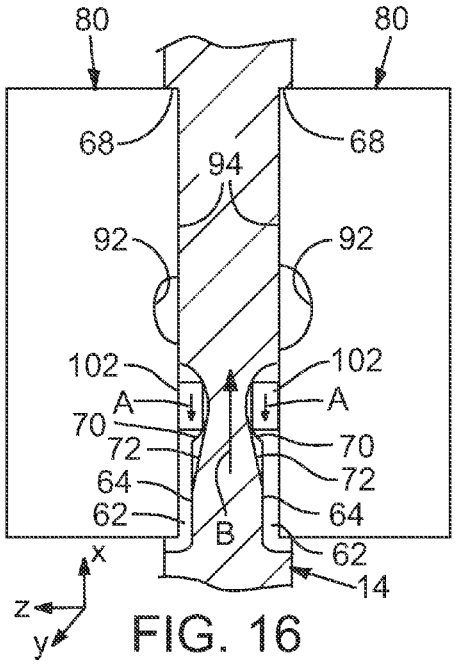

FIG. 16 illustrates the structural arrangement of the blade, torsion springs and bushings when the blade is in the open position. FIG. 16 roughly corresponds to FIG. 10.

Figure 17:
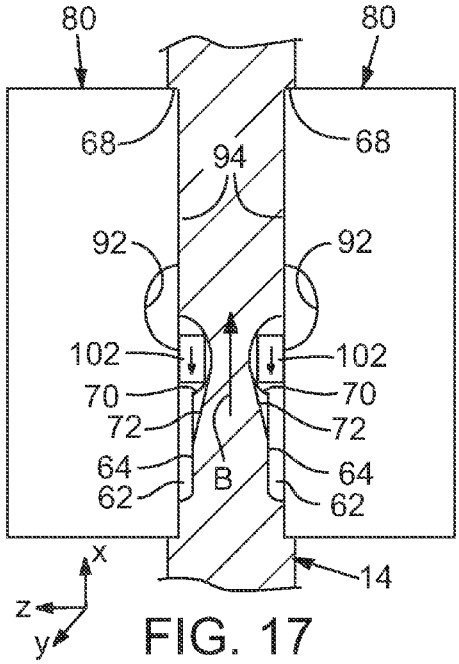

FIG. 17 illustrates the structural arrangement of the blade, torsion springs and bushings when the blade is rotated about 120° from the fully open position toward the closed position. FIG. 17 roughly corresponds to FIG. 11.

Figure 18:
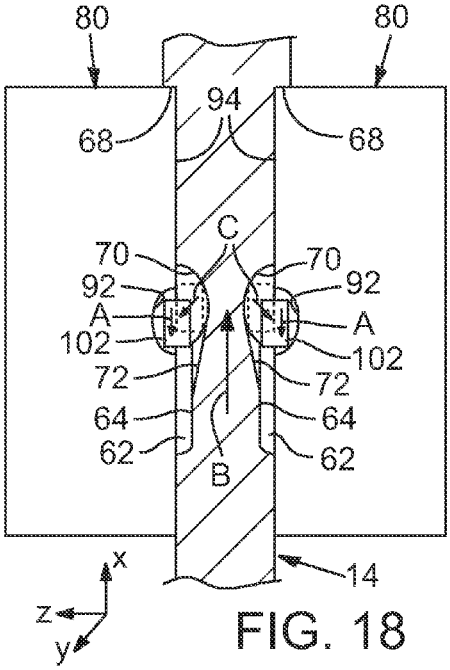

FIG. 18 illustrates the structural arrangement of the blade, torsion springs and bushings when the blade is 140° from the fully open position toward the closed position. FIG. 18 roughly corresponds to FIG. 12.

Figure 19:
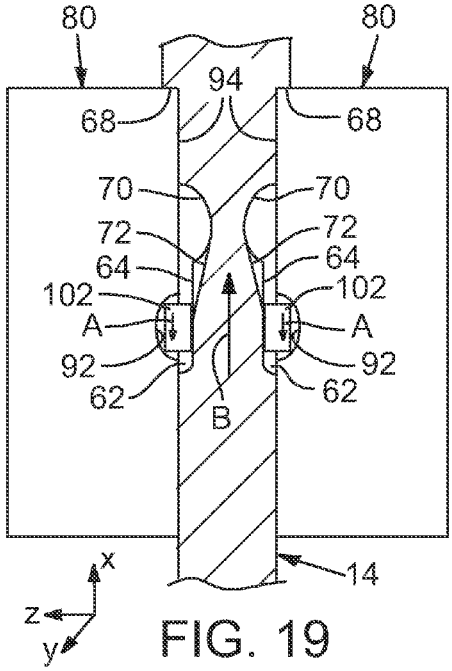

FIG. 19 illustrates the structural arrangement of the blade, torsion springs and bushings when the blade is in the closed position. FIG. 19 roughly corresponds to FIG. 13.

Figure 20:
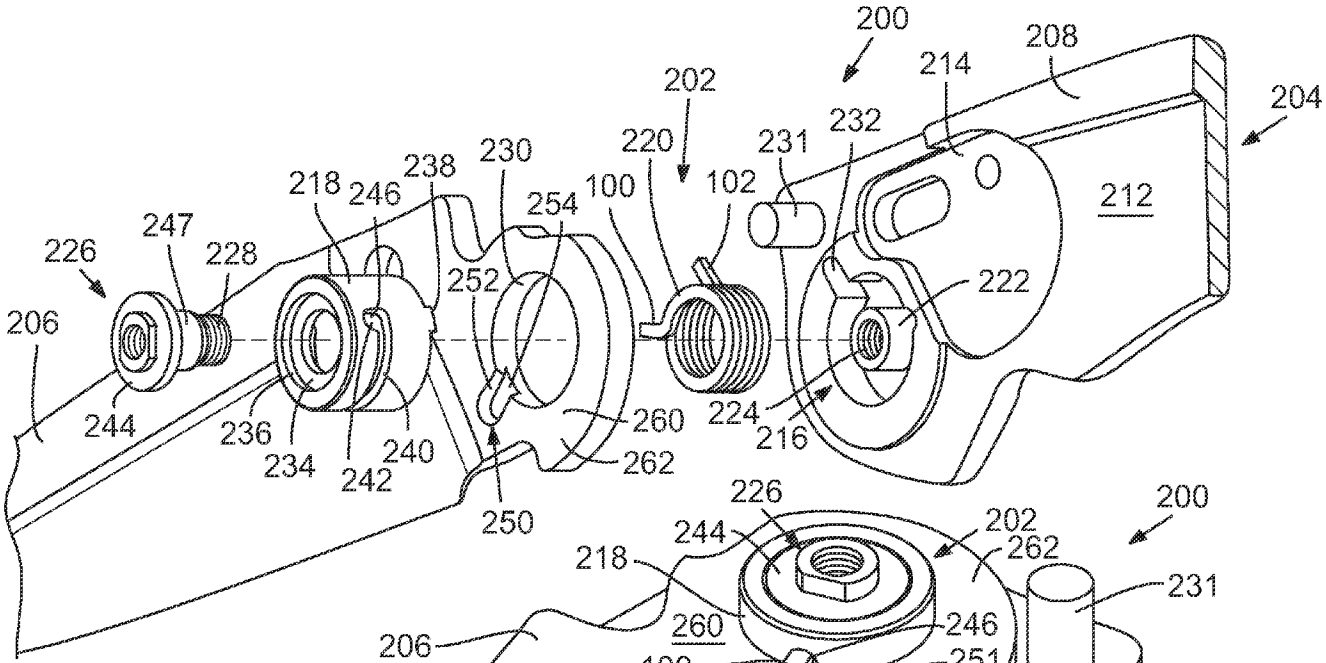

FIGS. 20 through 25 illustrate another preferred embodiment of an opening assist mechanism according to the present invention. Specifically, FIG. 20 is a perspective and partially cut away view of select structures of a knife illustrating an opening assist mechanism according to the present invention, showing the various parts in an exploded view.

Figure 21:
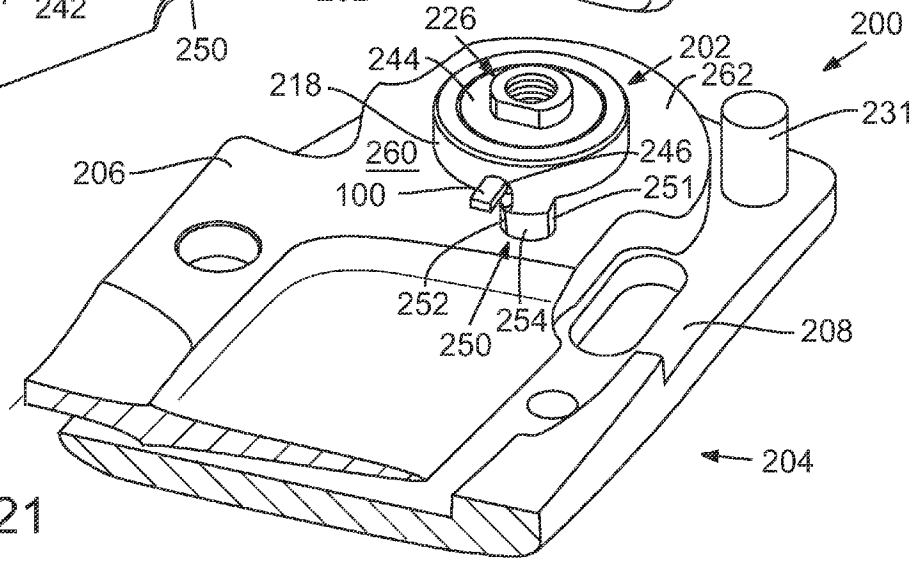

FIG. 21 is a perspective cross sectional view of select structures of the knife shown in FIG. 20, illustrating the blade assembled with one handle sidewall with the blade in the closed position.

Figure 22A:
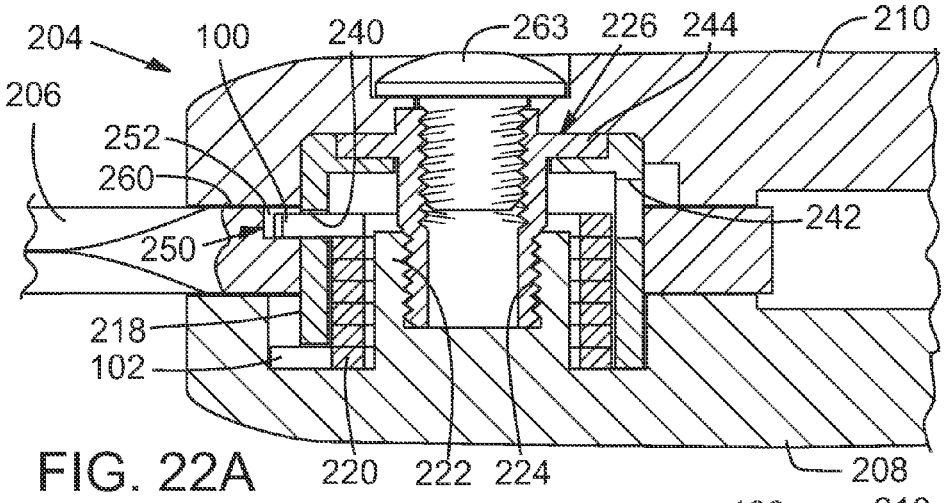

FIG. 22A is a cross sectional view of the opening assist mechanism structures of the knife shown in FIG. 20, with the blade in the fully open position.

Figure 22B:
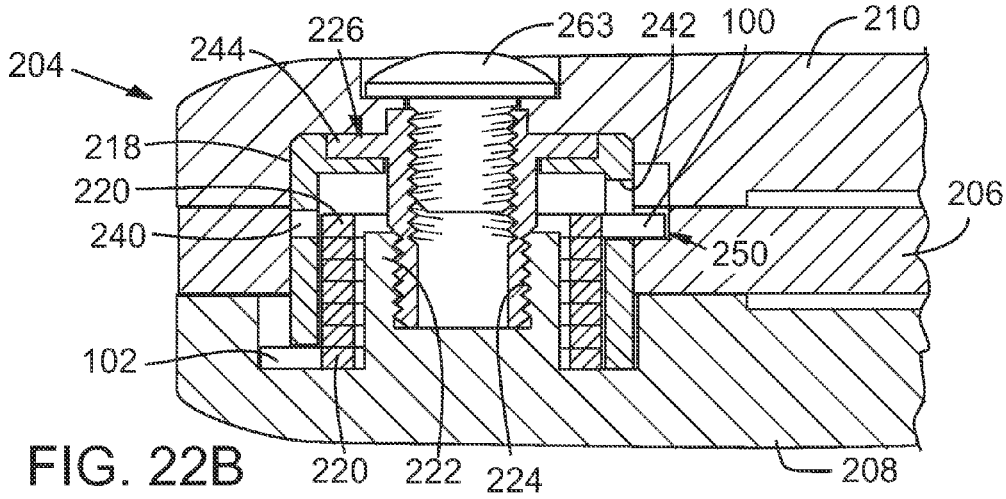

FIG. 22B is a cross sectional view of the knife shown in FIG. 22A with the blade rotated to an intermediate position between fully open and fully closed, and with the leg of the spring engaging the blade in a position to drive the blade from closed to open.

Figure 22C:
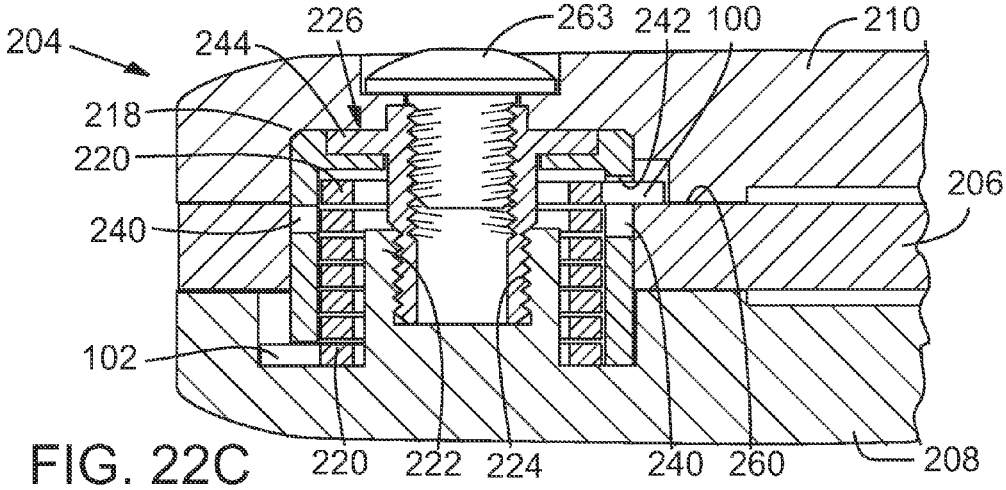

FIG. 22C is a cross sectional view of the knife shown in FIGS. 22A and 22B with the blade in the fully closed position.

Figure 23:
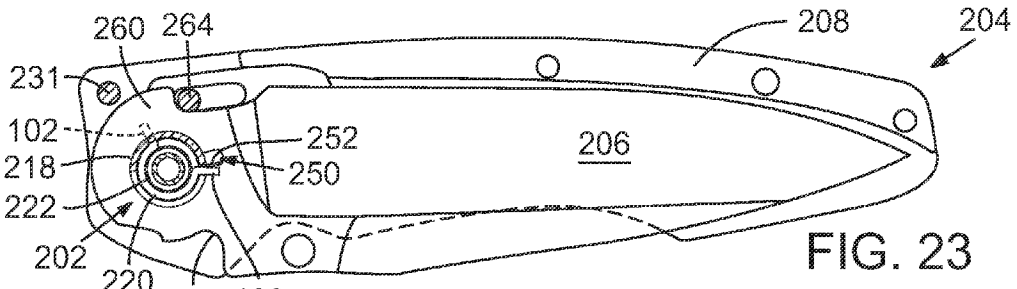

FIG. 23 is an elevation view of a knife incorporating the opening assist mechanism shown in FIG. 20, with the near sidewall removed to expose the blade and opening assist mechanism structures and the blade in the closed position.

Figure 24:
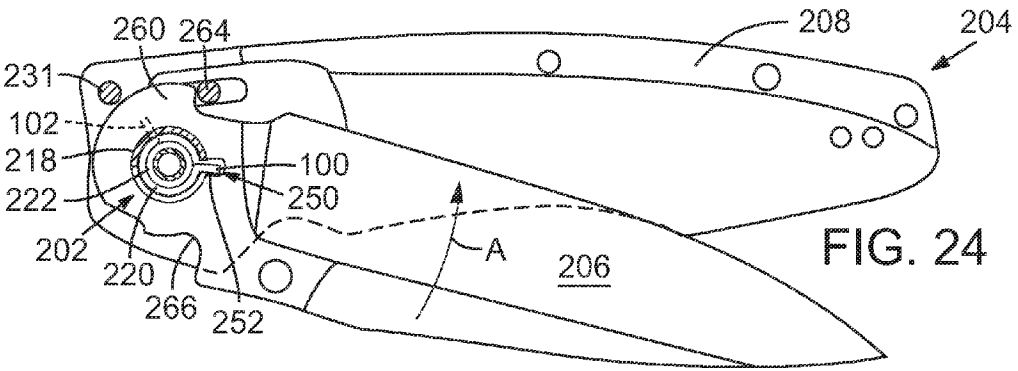

FIG. 24 is an elevation view similar to FIG. 23 except illustrating the blade at an intermediate position as it is being moved from the open to the closed position.

Figure 25:
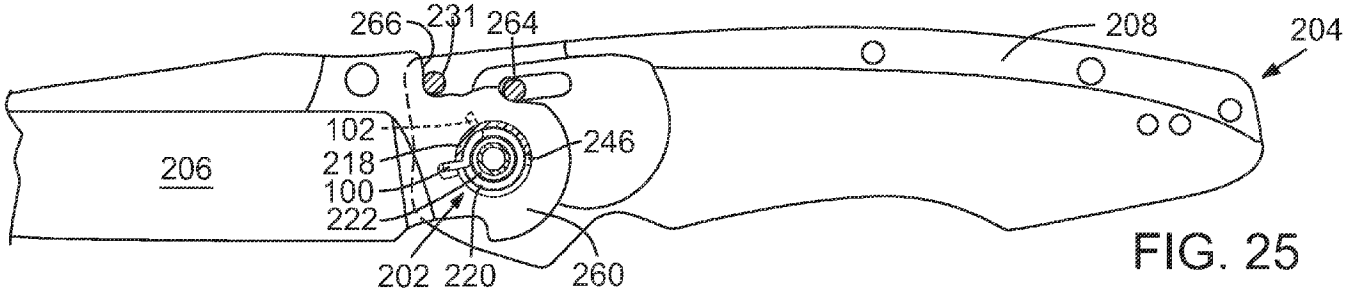

FIG. 25 is an elevation view similar to FIGS. 22 and 23 except showing the blade in the fully open position.

DETAILED DESCRIPTION OF THE PREFERRED EMBODIMENTS

Figure 2:
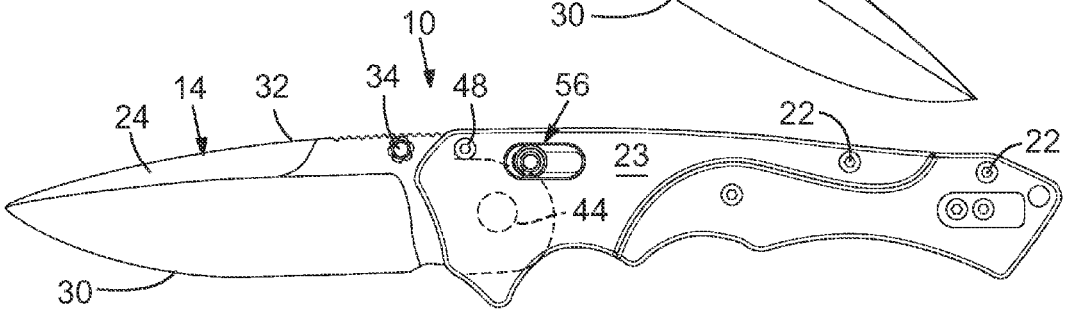
FIG. 2 is side elevation view of the knife illustrated in FIG. 1.
Figure 3:
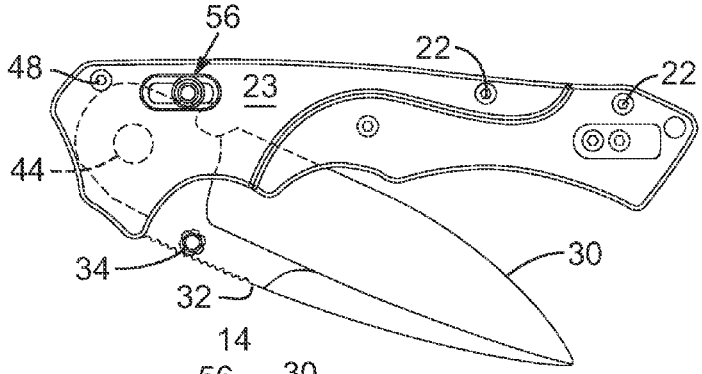
FIG. 3 is side elevation view similar to FIG. 2 with the blade shown midway between the open and closed positions.

A first illustrated embodiment of a folding knife 10 incorporating an opening assist mechanism according to the present invention is illustrated in FIGS. 1 through 19. Folding knife 10 includes an elongate handle 12, and a blade 14 that is pivotally attached to the handle at one of its ends—referred to herein as the "forward" end of the handle. Other relative directional terms correspond to this convention: the "rear" or butt end of the handle is opposite the forward end; the "upper" part of the blade is the dull, non-working portion and the "lower" part of the blade is the sharpened, working portion; "inner" or "inward" refers to the structural center of the knife, and so on. FIGS. 1 and 2 show the knife 10 with the blade 14 in the open position. FIG. 3 illustrates the blade midway in its rotation from the open to the closed position, and in FIG. 4 the blade is shown in the closed position in which the blade, shown partly in dashed lines, is received in a blade-receiving groove defined within the handle 12 between the sidewalls. An X-Y-Z axis grid is shown in FIG. 1. The X-Y plane is defined as the plane parallel to the plane defined by the handle 12 and blade 14—the blade travels in the X-Y plane as it is rotated between the closed and open positions. The Z plane is the plane transverse to the X-Y—the blade pivot pin extends longitudinally in the Z-plane.

The blade 14 of the knife 10 of the present invention incorporates a blade locking mechanism so that blade may be locked securely in the open position to prevent the inadvertent movement of the blade to its closed position. The blade locking mechanism is described below.

Handle 12 of knife 10 comprises several components, including a pair of oppositely located side wall sections, generally indicated at 16, 18, that are parallel with each other and held spaced apart from one another by spacers 20, only one of which is shown in FIG. 1. Each of the side wall sections 16 and 18 comprise an inner liner and an outer plate that are held parallel to one another. Specifically, side wall 16 is defined by liner 17 and outer plate 19. Likewise, side wall 18 is defined by liner 21 and outer plate 23. The spacers 20 are cylindrical sleeves that have a threaded internal bore into which screws 22 are threaded. The screws thus secure the spacers between the liners 17 and 21 of side walls 16 and 18 to maintain the handle 12 in a secure relationship with side walls 16 and 18 held in a spaced apart relationship. Side wall sections 16 and 18 may be fabricated from any suitable material such as a reinforced synthetic plastic; other suitable materials include metal, other plastics, wood, etc. The side wall sections may be fabricated in singled or multiple pieces. As shown in FIG. 1, an optional pocket clip 17 may be included if desired—the clip is attached to the exterior surface of side wall 16.

The blade 14 is pivotally attached to the handle 12 near the forward end of the handle. The blade used with knife 10 may be of any known type. The blade 14 shown in the drawings comprises an elongate working portion shown generally at 24 and a tang portion, shown generally at 26. The blade 14 is pivotally attached the handle 12 with a blade axis pin (detailed below). Working portion 24 typically includes a sharp edge 30 and a blunt edge 32. A thumb lug 34 may be included on blade 14 to assist with opening and closing the blade.

A blade receiving groove 36 is defined between the side walls 16, 18 by virtue of the spacers 22, described above. The blade receiving groove 36 defines a slot into which the blade 14 is received when it is moved to its closed position, as shown in FIG. 2. When the blade is in the closed position, the sharp edge 30 of the blade is held safely within the confines of the handle.

Figure 5:
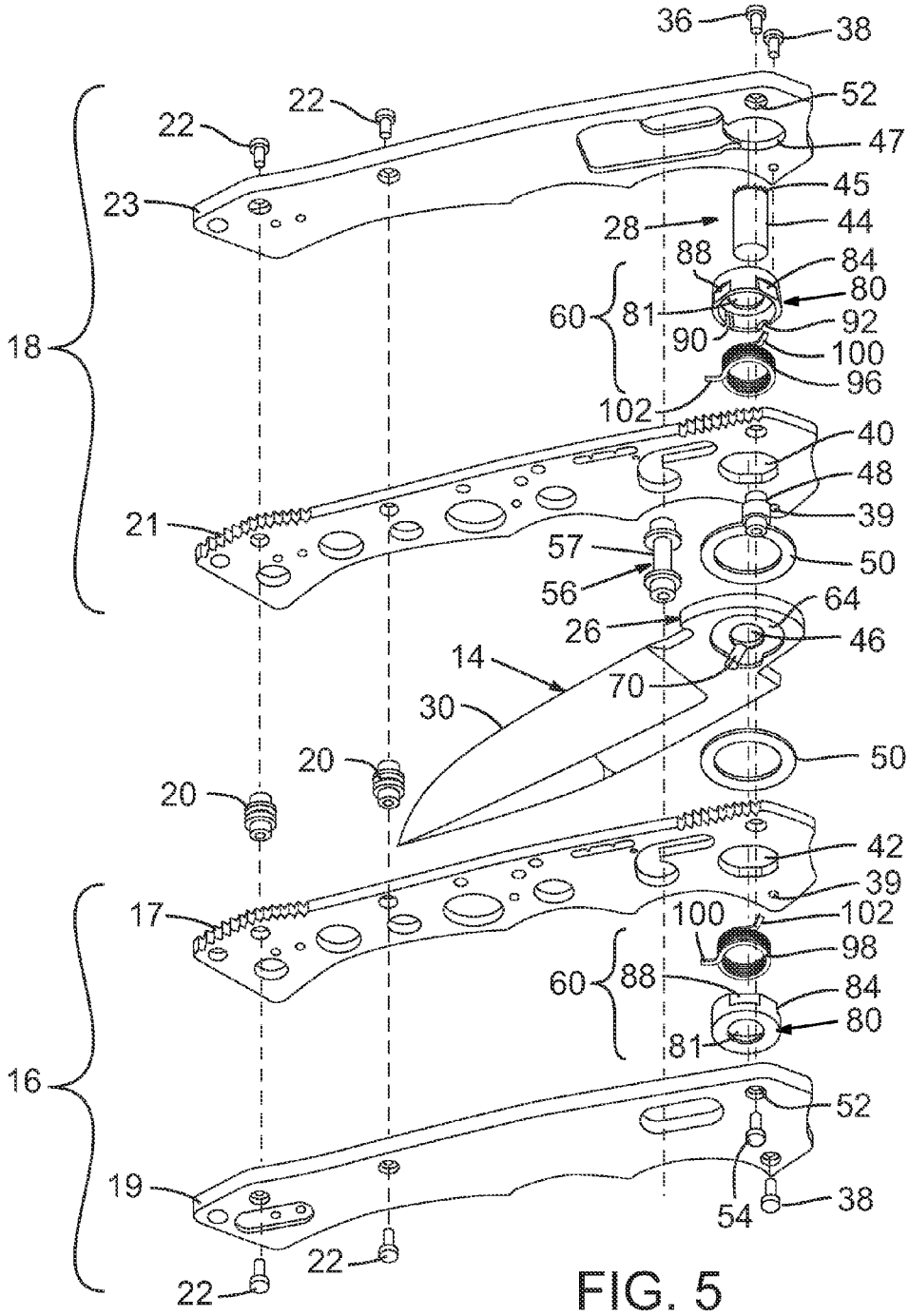
FIG. 5 is an exploded, perspective view of the knife of FIG. 1, illustrating selected component parts.

Blade 14 is attached to handle 12 such that the blade's working portion 24 extends away from the handle 12 when the blade 14 is in its open position (FIG. 1), and tang portion 26 is located within the blade receiving groove 36 between the paired handle side walls when the blade is in either the open or the closed position. That is, the tang portion 26 is always located between the side walls 16 and 18 of handle 12. The blade is pivotally attached to the handle with blade axis pin, which extends transverse to the plane of the blade and defines a blade pivot shaft. Turning briefly to FIG. 5, blade axis pin 28 is defined by a cylindrical sleeve 44 that extends through a bore 40 formed in liner 21, and an aligned bore 42 formed in the liner 17. The sleeve also extends through aligned pivot bore 46 through tang portion 26 of blade 14. In the assembled knife 10, cylindrical sleeve 44 is fitted snugly and fixedly through the pivot bore 46 in tang 26 of blade 14 so that the sleeve defines a rotational pivot axis for the blade extending transversely with respect to the plane of the blade and the side walls. Thus, sleeve 44 is axially aligned in the Z-direction—transverse to the X-Y plane. With continuing reference to FIG. 5, one of the ends of sleeve 44 has a lip 45, the outer circumference of which is knurled. The opposite ends of the sleeve 44 are received in circular counter bored recesses 47 in the respective handles, only one of which is shown in the view of FIG. 5. Washers 50 lie between the blade 14 and the liners 17 and 21 such that the sleeve 44 extends through the washers.

A blade stop pin 48 has its opposite ends anchored in counter bored holes 52 formed in outer plates 19 and 23 and held in place with screws 36 and 54 (only one of the counter bored holes 52 is shown in the view of FIG. 5). Screw 38 shown in FIG. 5 threads into a threaded opening 39 in liner 17—an identical screw threads into a threaded opening 39 in liner 21.

When the knife 10 is assembled with the various screws and spacers described above and shown in the drawings, the opposite ends of the cylindrical sleeve 44 are securely captured in the counter bored recesses 47 and the knife is very stable.

As noted previously, knife 10 incorporates a locking mechanism for locking the blade in the open position. With reference to FIG. 5, the locking mechanism is shown generally with reference number 56 is fully described in U.S. Pat. No. 6,574,869, which is assigned to the assignee of the present invention, and the disclosure of which is incorporated herein by this reference. More specifically, the locking mechanism 56 used in knife 10 of the present invention is the same as the locking mechanism described in FIGS. 14 through 17 of U.S. Pat. No. 6,574,869 and described in the specification of that patent. It will be appreciated that because the locking mechanism 56 does not form a part of the present invention, not all of the component parts of the locking mechanism are shown or identified with reference numbers in the attached drawings. Nonetheless, blade locking pin 57 is identified; it is a spring-loaded pin that extends through the knife handle with its opposite ends extending through slots in the handles. The pin 57 locks the blade in the open position by virtue of its contact with a specialized surface of the tang 26. It will further be appreciated that there are many different kinds of locking mechanisms that will work well in connection with the opening assist mechanism described herein, including for example liner locks and lock back mechanisms.

Figure 9:
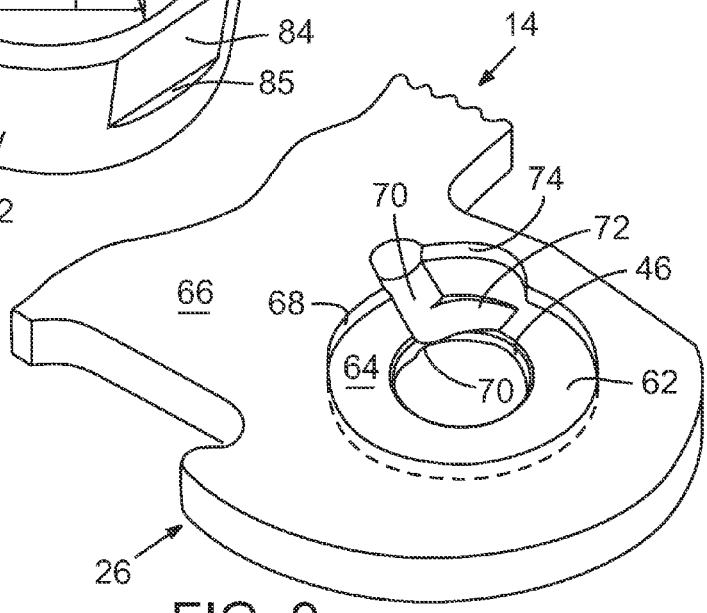
FIG. 9 is a perspective view of the tang portion of the blade, illustrating the blade pocket in which a torsion spring resides.

With reference to FIG. 5, knife 10 incorporates an opening assist mechanism 60 that comprises several components. The mechanism 60 will be described generally initially with reference to several drawing figures, and its structure and operation will then be detailed with reference to other drawings. As illustrated in FIG. 9, the tang portion 26 of blade 14 has a circular recess 62 formed annularly around the bore 46 through which blade axis pin 28 extends. The shelf 62 defines an annular depression in the surface of the tang of the blade that may be formed by milling the blade, or during casting of the blade. Thus, the recess 62 has a base surface 64 that is recessed below the level of surface 66 of the remainder of the tang 26. A step 68 forms the outer peripheral edge of the base shelf 64. A pocket or groove 70 is formed in recess 62 such that the groove radiates outwardly from the central axis through bore 46. The groove 70 defines a section of a cylinder so that its walls are curved. As detailed below, because the walls of the groove are angled, the spring leg that rides in the groove at some times during rotation of the blade is able to transfer into and out of the groove. An angled or ramped section 72 extends from one side of the groove 70 at the edge of bore 46 and slopes upwardly a short radial distance until the ramped section meets the level of base surface 64. For the reasons detailed below, the ramped section 72 is optional. Finally, the circular recess 62 includes a scalloped out portion 74 extending from the outermost edge of groove 70 a short radial distance around the circular recess. The edge of the scalloped out portion 74 defines a portion with a larger diameter than the remainder of the circular recess 62.

Although only one side of blade 14 is shown in FIG. 9, it is to be understood that the opposite side of blade 14 includes a circular recess identical in structure to the one described herein, although as detailed below, the structures of the circular recess on the opposite side of the blade are axially rotated relative to the structures illustrated in FIG. 9.

Figure 8:
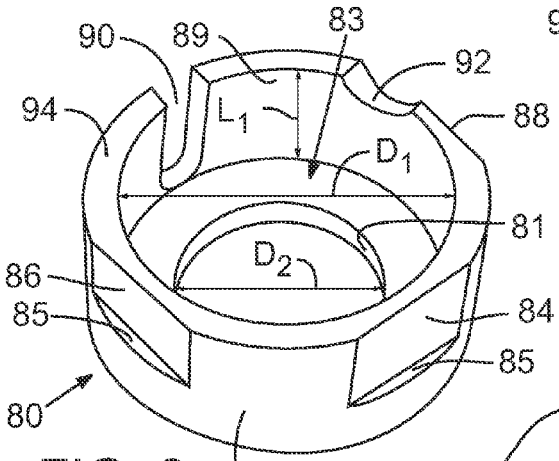
FIG. 8 is a perspective a view of one of the bushings.

The next structure that is a component of the opening assist mechanism 60 is illustrated in FIG. 8, and comprises a bushing 80. Bushing 80 is a generally cylindrical member 82 that has three flattened portions 84, 86 and 88 formed at intervals around the outer wall of the bushing. Each of the flattened portions extends partially along the cylindrical wall 89 of bushing 80, defining a stop 85 for each flattened portion. As detailed below, the bushing is inserted into a cooperatively shaped circular opening in the liner, which has three flattened portions that correspond to the three flattened portions 84, 86 and 88 on the bushing. The three flattened portions of the bushing cooperate with the flattened portions of the openings in the liners to fix the busing relative to the liner and thereby prevent the bushing from rotating relative to the liner. The "interior" of bushing 80 defines a first diameter D1 in FIG. 8, and the opening 81 at the "closed" end 83 of the bushing defines a second diameter D2 that is smaller than D1. The inner cylindrical wall 89 defines a height L1. Finally, there is a first notch 90 and a second notch 92 formed in the inner annular edge 94 of cylindrical wall 89. Second notch 92 is smaller than first notch 90. The diameter of the interior opening in the washers 50 is larger than the outer diameter of the bushings 80 so that when the knife is assembled, the bushings extend through the washers, as detailed below.

Figure 6:
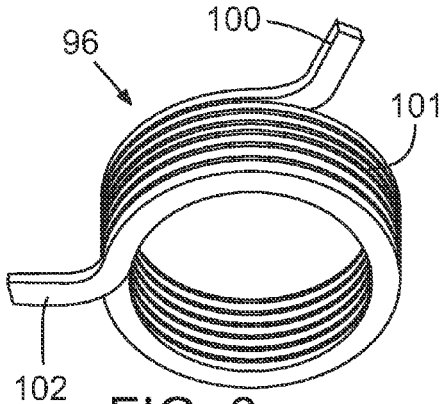
FIG. 6 is a perspective view of one of the torsion springs.
Figure 7:
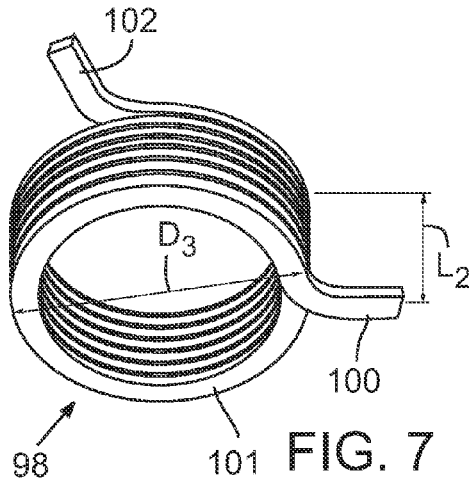
FIG. 7 is a perspective view of the opposite of the torsion springs.

Turning now to FIGS. 6 and 7, the two torsion springs 96 and 98 used in the opening assist mechanism 60 are illustrated. The springs 96 and 98 are mirror images of one another and have a body length L2 that is slightly less than height L1 of cylindrical wall 89 of bushing 80, and a diameter D3, which is slightly less than diameter D1 of bushing 80. Spring 96 is a left hand spring and spring 98 is a right hand spring. It will be appreciated that there are many different kinds of torsion springs that will suffice for use in the present invention. The torsion springs 96 and 98 illustrated herein are flattened wire type springs that having coiled body portions 101 and straight legs 100 and 102, which define spring ends.

The assembly of opening assist mechanism will be described with reference to one bushing and one torsion spring. However, as appreciated from the description herein and the drawings of the illustrated embodiment, the opening assist mechanism relies upon a bushing and torsion spring on each side of the blade. Nonetheless, an opening assist mechanism may be built based on the present disclosure that utilizes only one torsion spring. In other words, the opening assist mechanism according to the present invention may be fabricated with only one spring on one lateral side of the blade. While a spring on both sides of the blade is the preferred embodiment, a single spring mechanism is suitable.

With returning reference to FIG. 5, knife 10 is assembled with torsion springs 96 and 98 received in the circular recesses 62 on opposite sides of blade 16 such that the innermost legs 102 of the springs are received in the recesses. The outermost leg 100 of each torsion spring rests in notch 90 in bushing 80. Bushing 80 is inserted through bore 42 liner 17 with the flattened portions 84, 86 and 88 aligning with corresponding flattened portions formed in the liner. The bushing may be inserted through bore 42 until the stops 85 abut the outer wall of the liner. As noted above, the flattened portions of the bushing 80 cooperated with the flattened portions of the bore 42 through liner 17 to fix the bushing relative to the liner. In other words, bushing 80 cannot rotate. Spring 98 is captured within the interior of bushing 80, and is retained in the bushing because the diameter D2 of bushing 80 is less than the diameter D3 of the springs. The spring 96 and bushing 80 on the opposite lateral side of blade 14 are assembled with liner 21 in the identical manner. "Outer" leg 100 of spring 96 is captured in notch 90 in the bushing. Because the bushing cannot rotate and leg 100 of the spring is captured in notch 90, one leg of each spring is fixed relative to the handle 12. Cylindrical sleeve 44 is inserted through the bushings, the springs, and the blade, and the opposite ends of the sleeve are retained in counter bored portions 47 in the respective outer plates 19 and 23 of handle sidewalls 16 and 18, respectively. The knurled outer lip on one end of sleeve 44 prevents rotation of the sleeve relative to the handle. It will be appreciated that because sleeve 44 is inserted axially through the center of the springs, the sleeve acts as a supporting arbor for the springs.

As indicated earlier, the body length L2 of spring 96 is slightly less than the height L1 of bushing 80. With the knife fully assembled and the handle halves screwed together, bushing 80, which as noted above is stationary with respect to handle 12, holds the innermost legs 102 of springs 96 and 98 in grooves 70 on both sides of the blade. The inner annular edge 94 of bushing 80 lies closely adjacent to the surface 64.

With returning reference to FIG. 9, when the knife 10 is assembled leg 102 of spring 96 resides in groove 70, at least at some times during rotation of the blade from closed to open, and from open to closed, as detailed below. The length of leg 102 is greater than the length of ramped section 72 of circular recess 62 (as show, for instance, in FIG. 10). Thus, when spring 96 is assembled with the other associated components, the end of leg 102 extends in groove 70 past the point where ramped section 72 ends. When spring 96 is under rotational torsion—i.e., when the spring is "loaded"—in the X-Y plane, the angular surface of groove 70 creates a force vector in the Z plane—i.e., transverse to the plane of the blade—that urges the leg 102 of spring 96 outwardly, away from the groove in circular recess 62, away from the longitudinally centerline through the blade. In other words, because at all times the surface of groove 70 that leg 102 is being forced against is angled, there is a force in the Z-plane that urges the leg out of the groove toward the bushing 80. Ramped portion 72 provides mechanical relief that allows the spring leg 102 to sit completely down into groove 70. As noted above and as shown in the drawings, the springs 96 and 98 are flat wire type springs. The relative geometric configurations between the spring leg and the sides of the groove 70 are important so that the spring leg will move into and out of the groove. It will be appreciated that the relative geometries described herein may be modified with the same functional characteristics being achieved.

The stationary bushing 80 holds the leg 102 in the groove 70, but as the blade rotates and winds the springs—i.e., loads the springs, the legs 102 slide along the inner annular edges 94 of bushings 80 until the inner portion of the legs begin to ride up the angled sides of the grooves 70. As the rotation continues and the legs 102 rotate toward notches 92 there is a force vector applied to legs 102 in the direction of the Z-plane by the angular edges of grooves 70. When the legs 102 align with notches 92 in bushings 80, the legs are forced very quickly into the notches. When the legs 102 are transferred into the notches 92, the rotational force of the springs is instantly removed from the blade and is transferred to the bushings, which as described above is stationary.

Figure 4:
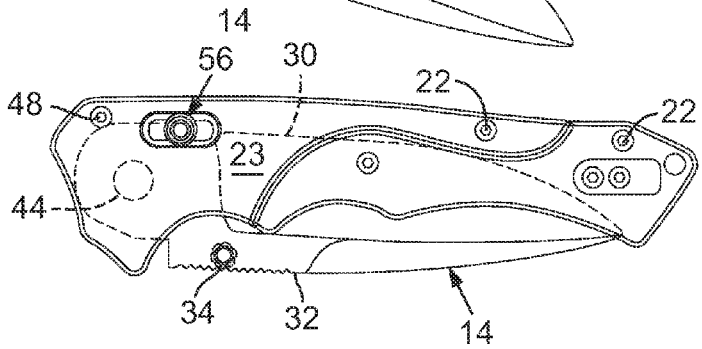
FIG. 4 is side elevation view of the knife illustrated in FIG. 3 showing the blade in the fully closed position.

Operation of the opening assist mechanism 60 will now be described in detail beginning with the blade 14 in the closed position (e.g., FIGS. 4, 13 and 15). When in the blade 14 is in the closed position there is no pressure applied to the blade by the opening assist mechanism 60. When the blade is in the closed position, the springs 96 and 98 are torsionally wound and loaded, but their rotational force is applied through legs 102 to the stationary bushings 80. Accordingly, no force is applied to the blade by the opening assist mechanism 60 and the blade is retained in the closed position by virtue of the force applied to the tang of the blade by the locking mechanism 56. This feature of the locking mechanism 56 is fully described in U.S. Pat. No. 6,574,869. The force applied to blade 14 by pin 57 is sufficient to retain the blade in the closed position, and the blade will not open even when, for example, the knife is dropped, or subjected to a strong "flick of the wrist" type of motion. Nonetheless, it may be beneficial to include a "safety" mechanism that prevents the blade from opening when the blade is in the closed position.

As stated previously, the diameter of the interior opening in the washer is larger than the outer diameter of the bushings 80. As best seen in FIG. 14, this results in the bushings 80 extending through the washers in the assembled knife.

It will be appreciated from the foregoing description, from the drawings, and from the more detailed description that follows, that the bushing 80 as described may be replaced by any number of equivalent structures. As one example, the functional and structural characteristics of the bushing and the way that it interfaces with the torsion spring may be reproduced with a "bushing" that is an integral part of the liner or handle, as opposed to a separate piece. As another example, the handle may be fabricated in a single piece and the bushing may be a part of the unitary handle half.

The drawings of FIGS. 10 through 13 illustrate a sequence that occurs when the blade 14 is moved from the closed position (FIG. 13) to the open position (FIG. 10). Typically, the blade is rotated by the user applying pressure to thumb lug 34. As blade 14 is rotated, the circular recesses 62, which are structural features of the tang 26, rotate. This causes the structures associated with circular recess 62 to be rotated relative to the fixed busing 80. This relative rotation between the blade, the bushing, and the spring that is retained in the bushing with one leg fixed thereto results in the functional operation of the opening assist mechanism.

Beginning with FIG. 13, as described earlier, the blade 14 is shown retained in this closed position by virtue of the forward pressure of pin 57 of locking mechanism 56. Thus, pin 57 is under spring tension that urges the pin in the forward direction illustrated by arrow A. At all times, leg 100 of spring 98 is captured and led stationary in notch 90 of bushing 80, and bushing 80 is held stationary by virtue of the flattened portions on the bushing mating with the flattened portions of the bore in the liner 21 through which the bushing extends. In FIG. 13, spring 98 is wound and thus has significant potential energy. However, leg 102 is in notch 92 and the potential energy of the spring is thus bearing against the stationary bushing 80 and does not apply any rotational pressure to the blade 14 (i.e., in the X-Y plane), although there is force applied to the blade in the Z-plane direction by virtue of the curved edge of notch 92.

Turning to the next illustration in the sequence, FIG. 12, the blade has begun its rotation toward the open position (arrow B). Here, the leg 102 of spring 98 remains in notch 92. As a result, the potential energy of the spring has not been released and is still exerted against bushing 80. Simultaneously, the pin 57 has been urged rearwardly, toward the butt end of the handle 12, as the pin rides over the surface of the tang of the blade. Because the sides of notch 92 are curved, the leg 102 is at all times bearing on a curved surface. This is the same mechanical characteristic as described above with respect to leg 102 riding in groove 70. As a result, because the spring is applying significant pressure against the side of the notch, there is a force in the Z-plane direction that urges the leg in the direction toward the tang of the blade—i.e., out of notch 92. This applies some pressure between the leg 102 and the blade in the Z-plane, but this is not rotational pressure that would drive the blade open.

In FIG. 11, the blade has rotated in the counterclockwise direction in the drawing so that leg 102 is just on the threshold of being forced out of notch 92 in bushing 80. When leg 102 is forced out of notch 92 the leg immediately moves into and engages groove 70. Since the spring is wound and loaded, movement of the spring leg into groove 70 results in the immediate transfer of the potential energy from the stationary bushing 80 to the rotatable blade 14. The spring thus instantly applies its force as the spring uncoils to the blade to urge the blade rapidly to the open position.

In FIG. 10 the blade is shown in the open and locked position. In this position an edge on the tang of the blade abuts stop pin 48, which stops the rotation of the blade. The blade is locked by virtue of pin 57 extending transversely across the upper edge of the tang and being wedged between handle side walls and the blade. It may be seen in FIG. 10 that the leg 102 is resting in groove 70, having rotated in the counterclockwise direction in the drawing away from notch 92. Ideally, in this position, spring 98 still exerts pressure on the blade in order to maintain this position.

Attention is now directed to FIG. 14, which illustrates knife 10 with blade 14 in the open position, and which is a close up cross sectional view taken through the portion of the handle and blade where the blade attaches to the handle. With blade 14 in the open position, legs 102 of torsion springs 96 and 98 are resting in grooves 70 of the circular recesses 62 formed in both sides of tang 26. The springs are maintained within the grooves 70 by the inner annular edge 94 of bushing 80. The springs 96 and 98 are still slightly wound, or loaded, in this position, so they continue to exert some pressure on the blade and thereby force the blade against the stop pin 48. The fixed legs 100 of both springs are seen captured in notches 90 of bushing 80, and notches 92 are of course not occupied. Because the springs continue to apply pressure to the blade when the blade is in the open position, the lock mechanism is assured of positive locking. This may be contrasted with many opening assist mechanisms, which drive the blade to open but do not apply pressure to the blade after a certain point in the blade's rotation. This results in the possibility of failure to lock.

FIG. 15 is similar to FIG. 14 except it shows knife 10 with blade 14 in the closed position. Here, the springs 96 and 98 are fully wound and thus fully loaded with potential energy. However, in this position the legs 102 have been forced out of contact with blade 14 and thus reside in notches 92 where they apply their potential energy against the stationary bushing 80.

It will be appreciated that when the blade is in the open position the locking mechanism may be unlocked and the blade may be rotated to the closed position. The sequence of events that occur as the blade moves from open to closed is shown by the series of drawings of FIG. 10 through FIG. 13. Beginning with FIG. 10, the blade is unlocked by moving the pin of locking mechanism 56 rearwardly toward the butt end of the knife so that the pin disengages from the tang of the blade. The blade is then rotated in the clockwise direction in FIG. 10 (i.e., opposite the direction of arrow B). As this happens, the leg 102 is pushed by the edge of groove 70, thereby winding spring 98.

As rotation of the blade continues in the clockwise direction, the spring continues to be wound, or loaded, imparting greater potential energy to the spring. In FIG. 11 the leg 102 is still in groove 70, but the position of the leg 102 is approaching the point where the leg aligns with notch 92. In FIG. 12 the leg 102 has aligned with notch 92 and the leg 102 is forced from groove 70 into notch 92, thereby transferring the spring pressure from the blade to the bushing. The primary structure causing leg 102 to be forced from the groove 70 into notch 92 is the sloped sides of the groove 70, which tend to "lift" the leg in the Z-plane, toward notch 92. The ramped portion 72 contributes additional "lifting" action that forces the leg in the Z-plane and into notch 92, but as noted above, the primary function of ramped portion 72 is to allow leg 102 to rest completely in the groove 70.

In FIG. 13 leg 102 may be seen in notch 92. As a result, the blade rotates freely into the closed position. And as noted above, the spring pressure applied to locking mechanism 56 urges the pin of the mechanism forward, retaining the blade in the closed position.

Attention is now directed to the series of drawings of FIGS. 16 through 19, which comprise a sequential series of semi-schematic illustrations showing the structure and functional attributes of the opening assist mechanism. In this series of drawings the only components that are shown are the bushings 80, the legs 102 of springs 96 and 98, and a small portion of blade 14. These drawings are semi-schematic because they omit for clarity certain structures that would normally be seen in these views. Moreover, as noted above, the structures in the circular recesses 62 on each side of the blade are axially rotated relative to one another. In other words, groove 70 on one side of the blade is not in the same position as groove 70 on the opposite side of the blade. The primary reason for this relative rotation of the structures is to maintain the strength and integrity of the blade. But as such, not all of the structures shown in FIGS. 16 through 19 would actually be seen if these cross sectional views were structurally accurate. However, they are presented here in the manner shown in order to facilitate a detailed explanation of the invention and how it operates.

Beginning with FIG. 16, blade 14 is in the open position. Legs 102 of both torsion springs (96 and 98) are retained in grooves 70 because the inner annular edges 94 of the bushings 80 are held closely abutting the surface of the tang 26 of the blade. The springs are slightly loaded, and the direction of the force that the springs apply to the blade is shown with arrows A. Arrow B represents the vector direction in which force is applied to blade 14 to move it from the open position toward the closed position. In this blade-open position, notches 92 are unoccupied.

In FIG. 17 the blade has begun its rotation from the open position toward the closed position. As this occurs, the springs 96 and 98 are being wound—loaded. That is, as the blade is rotated (represented by arrow B—which corresponds to clockwise rotation of the blade in the view of FIGS. 10 through 13), the legs 102 are carried and pushed by the grooves 70 to wind the springs. Notches 92 are still unoccupied, but the position of the notches is approaching the position of the legs 102.

In the next sequential drawing of FIG. 18, as rotation of blade 14 continues in the direction represented by arrow B, notches 92 have now rotated to the point where the notches begin to align with the legs 102 of the springs, and the legs 102 are simultaneously being "lifted" in the direction of the Z-axis by the curved sides of grooves 70—represented by arrows C. Once the legs 102 are able to be received in notches 92 they are pushed into the notches by the curved sides of grooves 70 and the spring force (arrows A) is immediately transferred from the blade 14 to the bushing 80. The blade is at this point under no spring force applied by the opening assist mechanism and is thus freely rotatable to the closed position. When a locking mechanism such as that described above is used with the knife, the transverse pin 57 at this point urges the blade to continue toward the closed position.

In the final drawing of this sequence, FIG. 19, the blade 14 is in the closed position and there is no spring force being applied to the blade by the springs 96 and 98. As noted above, springs 96 and 98 are under considerable potential energy, but that energy (arrows A) is being directed only to bushing 80. The legs 102 are in this position resting in the scalloped out portions 74 of the circular recesses 62.

From the foregoing description it will be appreciated that the opening assist mechanism described with reference to FIGS. 1 through 19 may be applied to a multitude of other equivalent mechanical constructs. As noted above, it will be appreciated that bushing 80 may be eliminated and replaced by any structure and method for connecting the torsion spring to the liner or handle. Bushing 80 may in this sense be seen as an optional structure that could be replaced by any equivalent structure for performing the function. There are many structural equivalents that can perform the function. As one example, the structure defined by the bushing could be formed as an integral part of the liner or handle rather than as a separate structure as described above in the preferred embodiment. Further, the bushing could be replaced by a recess formed in the liner that serves to contain the spring, fix one spring leg, and defines a notch into which the other spring leg may reside to remove spring pressure from the blade and transfer the spring pressure to the liner. With this as context, the word "bushing" as used herein is not limited to a structure that is separate from the liner or handle, but instead should be read to encompass any structure that facilitates the function ascribed to the bushing herein.

A second illustrated embodiment of a folding knife 200 incorporating an opening assist mechanism according to the present invention is illustrated in FIGS. 20 through 25. Only select structural parts of folding knife 200 are illustrated in order to describe the knife opening assist mechanism, referenced generally with reference number 202; those of skill in the art will readily understand that the description of knife 10 above otherwise applies fully to knife 200. In FIGS. 20 through 25, knife 200 includes an elongate handle 204, and a blade 206 that is pivotally attached to the handle at the forward end of the handle. The handle 204 comprises opposed sidewalls 208 and 210 (FIGS. 22A, 22B and 22C).

Only sidewall 208 is shown in FIG. 20 in order to illustrate the components of opening assist mechanism 202. The inner surface 212 of handle sidewall 208 includes a first recessed portion 214 that is associated with springs and other component parts (not shown) that are utilized a blade locking mechanism that is not the subject of the present invention. Immediately forward of the first recessed portion 214 is a cylindrical recess 216 that defines a seat for receiving the bushing 218, which as detailed below, retains a spring 220. Cylindrical recess 216 includes a cylindrical inner stud 222 that has a threaded interior bore 224, the central axis of which defines the axis of the pivot shaft about which blade 206 pivots as it moves between the open and closed positions. As detailed below, a pivot screw 226 has a threaded distal end 228. In the assembled knife, bushing 218 and pivot screw 226 extend through the pivot axis bore 230 in blade 206 with the threaded distal end 228 of the pivot screw is threaded into interior bore 224 to retain bushing 218 in place; as noted below, neither the pivot screw nor the bushing retain the blade 206 in place in the handle, other than the fact that the bushing extends through the pivot axis bore in the blade. Cylindrical recess 216 includes a groove 232 that radiates outwardly from the axis through bore 226 and which is configured to receive a leg of spring 220. A removable stop pin 231 is located immediately above recess 216.

Spring 220 is a torsion spring similar to the springs 96 and 98 described previously both in structure and function. Thus, spring 220 has a body length L2 and a diameter D3 (the dimensions L2 and D3 are not shown in FIG. 20 but correspond to the same dimensions shown for L2 and D3 in FIG. 7). Spring 220—is a flattened wire type of spring as described above and has straight legs 100 and 102, which define spring ends that radiate outwardly from the axis through the body of the spring.

With continuing reference to the exploded view of FIG. 20, bushing 218 is a housing with a cylindrical housing body sidewall and having on one end a recessed annular shelf 234 and a central axial bore 236 opening through the annular shelf into the interior of the housing. The interior of the bushing 218 is open to receive and retain the spring 220. The end of bushing 218 that in the assembled knife abuts handle sidewall 208 includes a tab 238 that is received into a cooperatively shaped notch (not shown) in recess 216. It will be appreciated that when the bushing is fully inserted into the recess 216 with tab 238 received in the notch, the bushing is fixed and cannot rotate relative to the handle. The diameter of bushing 218 is just slightly smaller than the diameter of pivot axis bore 230 through blade 206 and the diameter of recess 216 so that the bushing may be inserted through the blade and received into the recess during assembly, with close tolerances therebetween.

A partial annular groove 240 is formed in the sidewall of bushing 218 about mid-way along the length of the bushing housing and extending completely through the sidewall into the open interior of the bushing. The groove is referred to herein at times as a "partial annular groove" because as seen in FIGS. 20 and 23 through 25, the groove extends only partly around the circumference of the cylindrical bushing, preferably between about 180 to 225 degrees. The width of the groove is preferably the same along the length thereof, except at one end of the groove a groove extension 2462 opens in a direction transverse to the groove to define a widened portion. With specific reference to FIG. 20, it may be seen that the sidewall of groove extension 246 is sloped—this sloped sidewall is referred to as sloped sidewall 242.

As noted, the distal end of pivot screw 226 is threaded. The pivot screw has a flattened disk 244 at the proximal end, and a central portion 247 between the proximal and distal ends.

Blade 206 includes a notch 250 that extends outwardly away from the axis through bore 230 and which is configured to receive leg 100 of spring 220 at some times during rotation of the blade from open to closed, closed to open, as detailed below. Both of the side walls of the notch 250 on which leg 100 are sloped; specifically, as best seen in FIGS. 20 and 21, the first side wall 251 and the opposite second side wall 252 of notch 250 slope upwardly from the lower surface or floor 254 of the notch. The purpose and function of the sloping side wall 252 is described below. With reference to the specific view of FIG. 21, the first side wall 251 of notch 250 is on the right hand side of the notch—the second side wall 252 is on the left hand side of the notch.

With stop pin 231 removed from handle sidewall 208, knife 200 is assembled with blade 206 and opening assist mechanism 202 by first inserting bushing 218 partially through bore 230 in the blade and then inserting spring 220 into the open interior of the bushing with leg 100 extending through partial annular groove 240 and such that the leg 100 is received in notch 250 in the blade. The blade 206, bushing 218 and spring 220 are then aligned with and mated to handle sidewall 208 with the blade oriented about 90 degrees beyond the normal stop position (i.e., with the blade pointing upwardly relative to the handle). In this position, leg 102 of spring 220 is inserted in notch 232 and the spring is in a relaxed condition. The blade is then rotated toward the closed position and stop pin 231 is screwed into handle sidewall 208; this winds the spring so that the spring is under constant spring tension at all times in the assembled knife. Bushing 218 is rotated relative to the handle so that tab 238 is received in the cooperative notch in recess 216. It will be appreciated that with leg 102 of spring 220 in notch 232, the leg 102 is fixed relative to the handle sidewall 208, and the bushing is fixed relative to the handle by virtue of the tab 238 being received in the notch. As an alternate arrangement, the leg 102 could be fixed to a notch the bushing 218 instead of the handle itself; the leg 102 is fixed relative to the handle. Either way, at this point pivot screw 226 is inserted through bore 236 in bushing 218 and the distal end 228 is threaded into threaded bore 224. The flattened disk 244 at the proximal end of the pivot screw is received in the annular shelf 234 as the pivot screw is tightened. When the bushing 218 is tightened, partial annular groove 240 is positioned just below the plane defined by the outer surface 260 of tang portion 262 of blade 206. However, notch 250 in the blade is recessed in tang portion 262 relative to the plane of outer surface 260, and notch as best shown in FIG. 21, notch 250 opens to and communicates with the partial annular groove 240 in bushing 218. Thus, as blade 206 rotates from closed to open, and vice versa, notch 250 is open to partial annular groove 240 through the entire rotation. Moreover, as also best seen in FIG. 21, groove extension 246 extends to a level above the plane of outer surface 260 of the blade. As such, leg 100 of spring 220 is able to rise out of notch 250 in the blade and rest on outer surface 260 of the blade, as illustrated, when the blade is near and in the closed position.

It will be appreciated from examination of FIGS. 20 and 21 that at this stage of the assembly, blade 206 is retained in position relative to handle sidewall 208 only by virtue of leg 100 of spring 220 extending over the outer surface 260 of the tang portion 262 of the blade, for example, into notch 250 or as shown in FIG. 21, resting on outer surface 260. In other words, while bushing 218 is attached to handle sidewall 208 with pivot screw 226, the blade 206 is not directly attached to the handle or to the pivot screw. Instead, the blade is held in place only by virtue of the interaction of leg 100 of spring 220 as just described. The manufacturing tolerances between the various structural components are quite small, as is typical in the industry. As such, even without the second sidewall 210 assembled there is very little wobble between the blade and the sidewall 208 as the blade is rotated. As detailed below, this structural relationship between the blade and the handle provides significant assembly advantages.

With the blade 206 assembled with handle sidewall 208, the blade is moved into the closed position and stop pin 231 is installed in the sidewall as shown in FIG. 21. Since the blade is retained in this position, the opening assist mechanism is fully operational with only one sidewall 208 of handle 204 assembled with the blade.

Operation of the opening assist mechanism 202 will now be described with reference to the series of FIGS. 22A, 22B, 22C and FIGS. 23, 24 and 25, beginning with blade 206 in the open position shown in FIGS. 22A and 25. It will first be noted that in FIGS. 22A, 22B and 22C the second sidewall 210 is attached to first sidewall 208 with a number of screws (not shown) that extend from one sidewall to the other along the spline of the knife, and also a screw 263 that is inserted through the sidewall 210 and threads into the proximal end of pivot screw 226. With reference now to FIG. 25, with the blade in the open position a shoulder 266 on the tang portion 262 of blade 206 abuts stop pin 231 so that the blade is prevented from rotating past the open stop position (of FIG. 25). As detailed below, in the open stop position the spring 220 is "loaded" and pushing against the blade so that the blade is held in the open stop position. (Also in this position, a blade lock pin 264 engages the blade to prevent its unintended movement from the open stop position toward the closed position. The locking mechanism shown in the drawings, including blade lock pin 264, are not a part of the present invention.) In this open stop position, leg 100 of spring 220 is retained in partial annular groove 240 of bushing 218 and extends into notch 250 of blade 206, and because the spring 220 is wound, the leg 100 is pushing with spring force against side wall 252 of notch 205. This spring force applied against the blade maintains the blade in the open (and locked, stopped) position. As noted previously, the partial annular groove 240 is below the plane defined by surface 260 of blade 206, except at the groove extension 246. Thus, the groove is at the same level as notch 250 as the blade rotates. Stated another way, the groove is open to and communicates with the notch 250 along the entire length of the groove. However, at the extended groove portion 246 the groove 240 is open to both notch 250 and the outer surface 260 of the tang. This is best shown in FIG. 22A. As such, in the open position of FIGS. 22A and 25 (and at all blade positions except the closed position, described below), the leg 100 is retained in notch 250 by partial annular groove 240. Although side wall 252 is sloped, leg 100 cannot ride up the slope because the leg is bounded and retained in the partial annular groove 240. It will be appreciated that as described above, the leg applies spring force to the blade along the plane of blade rotation at all times when leg 100 is in groove 240, except when the blade is closed or near closed and leg 100 is resting on outer surface 260.

When the leg 100 is on outer surface 260, the leg applies spring force to the blade in a direction transverse to the plane of blade rotation.

Blade 206 is moved from the open, stopped and locked position of FIG. 25 by first unlocking any locking mechanism that may be in use (for example, with reference to FIG. 24, locking pin 264 is slid toward the rear end of the knife handle so that the tang of the blade clears the lock pin as the blade is rotated). Arrow A in FIG. 24 shows the direction of rotation of the blade as it moves from open toward closed. As the blade is rotated, leg 100 of spring 220 remains in partial annular groove 240 with the leg pushing against side wall 252 of notch 250 in the blade. Again, the spring is wound so that it is providing resistance to rotation of the blade as it rotates in the direction of arrow A. In addition, rotation of the blade in this direction further winds and loads the spring and thus increases the spring force applied by the spring to the blade. Because partial annular groove 240 is beneath the plane defined by surface 260 of blade 206, the leg 100 remains in partial annular groove 240 and notch 250 at all times during this phase of the rotation. As rotation of blade 206 continues from open to closed, notch 250 of the blade and leg 100 of the spring, which are rotating together, eventually align with groove extension 246 in the bushing 218. As the blade rotation approaches the closed position (starting with FIG. 22B and moving to FIG. 22C, and FIG. 23), leg 100 enters the point in partial annular groove 240 such that the leg 100 may move upwardly, along sloped side wall 252 and away from the body of the spring and into groove extension 2462—that is, the leg slides on the sloped sidewall 250 and then up the now-aligned sloped sidewall 242 of groove extension 246. As the leg 100 moves in this direction and as rotation of the blade continues, the leg is pushed up the sloped surface of side wall 252 of notch 250, enters groove extension 246. Once the leg has risen a sufficient distance into groove extension 246 the leg slides onto surface 260 of the blade, as shown in FIG. 21, under the force of the spring, which is driving the leg at all times toward the open position. Leg 100 cannot rotate further toward the open direction beyond the position shown in FIG. 21 because the leg is bounded by groove extension 246 of bushing 218, which as noted previously is fixed to sidewall 208 and cannot rotate.

The normal, or "resting" position of leg 100 relative to partial annular groove 240 is the position where the leg is in held in the groove. Thus, the resting position of the spring 220 is shown in FIG. 20 with all of the coils of the spring that make up the body held relatively tightly against one another. As such, when the leg is atop surface 260 as shown in FIG. 21, the coils of the spring are separated slightly from one another as the leg 100 is moved out of the resting position. As such, there is a downward force applied by the leg to the surface of the blade—the leg 100 is normally urged toward its resting position—transverse to the plane of blade rotation. However, once the leg assumes this position on surface 260, all rotational spring force applied to the blade by the spring stops because as noted the leg is bounded by groove extension 246, so all rotational spring force is applied to bushing 218. As noted, there is pressure applied by leg 100 to the blade; this force helps the blade to normally remain in the closed position until it is intentionally moved toward the open position, as detailed below. When a locking mechanism such as that associated with lock pin 264 is used, the locking pin (which is driven forward in the illustration of FIG. 23 with springs, not shown) further retains the blade in the closed position. Blade 206 is moved to the open position from the closed position by rotating the blade in the direction opposite arrow A in FIG. 24. As the blade is rotated, leg 100 slides on the surface 260 of the tang 262 of the blade until the notch 250 aligns with leg 100. Once the notch 250 aligns with leg 100, the leg assumes its normal "resting" position relative to the partial annular groove 240 and thus moves downwardly along sloped sidewall 252 and into the notch 250. As this occurs, leg 100 aligns with and enters the partial annular groove 240 and is free to "unwind." Thus, the leg 100 pushes against side wall 252 of notch 250 and because the leg has entered the partial annular groove and is bounded therein, the spring drives the blade quickly under spring force into the open, stopped and locked position.

As noted previously, the structural components that define the opening assist mechanism 202 allow the blade 206 to be attached to the handle and assembled with the opening assist mechanism with only one of the two sidewalls 208, 210 being assembled. Thus, when the knife is partially assembled as shown in FIG. 21, the opening assist mechanism is fully functional even though the blade is held in place only by the leg 100 of spring 202. This provides significant manufacturing and assembly economies. Specifically, the opening assist mechanism and lockup position may be adjusted during assembly prior to both handle sidewalls being secured in place. For instance, the stop pin described in U.S. Pat. No. 7,278,213, which is owned by the assignee of the present invention, allows quick adjustment of the lockup position of a blade. When a stop pin such as that described in the '213 patent is used in a knife such as that shown in FIG. 20 with the opening assist mechanism 202, technicians are able to very quickly adjust the knife operation and lockup during assembly. Moreover, because the blade is held in place with only one of the two sidewalls attached, assembly of the entire knife is much more efficient because the degree of manual dexterity required to assemble all of the various pieces is significantly reduced. In addition, as shown in the series of FIGS. 22A, 22B and 22C, the screw 263 is exposed to the outside of the knife. This allows a user to adjust the amount of blade wobble without affecting the operation of the opening assist mechanism 202. Thus, because the leg 100 retains blade 206 in place even when sidewall 210 is removed, a user may completely remove screw 236 without causing the opening assist mechanism to come apart. Many users desire to "customize" their knives by changing the rate at which the blade opens, or varying the wobble between the blade and the handle. The opening assist mechanism described above allows this type of user-customization without the danger of disassembly of a complicated opening assist mechanism.

While the present invention has been described in terms of a preferred embodiment, it will be appreciated by one of ordinary skill that the spirit and scope of the invention is not limited to those embodiments, but extend to the various modifications and equivalents as defined in the appended claims.

The invention claimed is:

1. A folding knife, comprising, a handle defined by first and second spaced apart handle halves;

a blade rotationally connected between the handle halves, said blade having a cylindrical pivot bore through a tang of the blade and said tang defining a tang surface around the pivot bore, the blade having a radial groove in the tang surface and the blade movable along a rotational path from a closed position to an open position, a bushing extending through the pivot bore and fixed relative to said first handle half, said bushing having a cylindrical body, an open interior and an annular groove extending around a portion of the cylindrical body and opening through the body into the open interior of the bushing;

a spring in the bushing, said spring having a first leg extending through the annular groove such that the first leg extends into the radial groove in the tang of the blade during a portion of the rotational path.

2. The folding knife according to claim 1 wherein said annular groove has a first end and a second end, and wherein the second end defines an extended notch portion.

3. The folding knife according to claim 2 wherein a width of the annular groove at the extended notch portion is greater than a width of the annular groove at the first end.

4. The folding knife according to claim 1 wherein said tang surface defines a plane and said annular groove is positioned below the plane.

5. The folding knife according to claim 4 wherein said annular groove is aligned with said radial groove in the tang of the blade so that said annular groove communicates with said radial groove.

6. The folding knife according to claim 5 wherein said annular groove communicates with said radial groove throughout the rotational path of the blade from the closed position to the open position.

7. The folding knife according to claim 4 wherein the annular groove at the extended notch portion is above the plane defined by the tang surface.

8. The folding knife according to claim 1 wherein the said first leg does not extend into the radial groove during a portion of the rotational path.

9. The folding knife according to claim 8 wherein the first leg is positioned on the tang surface when the blade is in the closed position.

10. The folding knife according to claim 1 wherein the spring further includes a second leg that is fixed relative to the handle.

11. The folding knife according to claim 1 wherein the radial groove has a floor surface and opposed sidewalls, and wherein at least one of said opposed sidewalls is sloped relative to said floor surface.

12. A folding knife, comprising, a handle defined by first and second spaced apart handle halves;

a blade having a tang connected between the handle halves and rotatable from a closed position to an open position along a blade rotation plane, said tang defining a tang surface around a bore through said tang;

a housing extending through the bore, said housing having a body, an open interior and a housing groove extending partially around the housing, said housing groove opening through the housing into the open interior;

a spring in the housing, said spring having leg a extending through the housing groove such that the leg is in contact with the blade and applies spring force to the blade to drive the blade from the closed to the open position.

13. The folding knife of claim 12 including a radial groove in the tang surface that extends to the bore through the tang.

14. The folding knife of claim 13 in which said housing groove has a first housing groove portion that communicates with the radial groove in the blade and is open to the tang surface, and a second housing groove portion that is open to the radial groove in the blade and closed to the tang surface.

15. The folding knife of claim 14 wherein said leg contacts said radial groove during a portion of the rotation of the blade from the closed position to the open position.

16. The folding knife of claim 14 wherein said leg does not contact said radial groove when the blade is in the closed position.

17. The folding knife of claim 15 wherein when said leg contacts said radial groove the leg applies spring force to the blade in a direction parallel to the blade rotation plane.

18. The folding knife of claim 16 wherein said leg contacts the tang surface when the blade is in the closed position.

19. The folding knife of claim 18 wherein when said leg contacts said the tang surface the leg applies spring force to the blade in a direction transverse to the blade rotation plane.

* * * * *